US006778008B2

(12) United States Patent
Andrews

(10) Patent No.: US 6,778,008 B2
(45) Date of Patent: Aug. 17, 2004

(54) PROCESS-COMPENSATED CMOS CURRENT REFERENCE

(75) Inventor: Paul Andrews, Sandia Park, NM (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/231,697

(22) Filed: Aug. 30, 2002

(65) Prior Publication Data

US 2004/0041623 A1 Mar. 4, 2004

(51) Int. Cl.[7] ..... G05F 1/10; G05F 3/02
(52) U.S. Cl. ..... 327/543; 323/315
(58) Field of Search ..... 327/538–540, 327/541, 543; 323/312, 313, 315, 316

(56) References Cited

U.S. PATENT DOCUMENTS 5,469,111 A 11/1995 Chiu ..... 327/538
5,811,993 A * 9/1998 Dennard et al. ..... 327/54
5,892,388 A * 4/1999 Chiu ..... 327/543
5,949,278 A * 9/1999 Oguey ..... 327/543

FOREIGN PATENT DOCUMENTS

JP 1-263706 10/1989

* cited by examiner

*Primary Examiner*—Quan Tra
(74) *Attorney, Agent, or Firm*—Aaron Waxler

(57) ABSTRACT

A current-compensating circuit provides compensation to a reference voltage such that the current through a diode-connected MOS transistor remains constant, regardless of threshold voltage. The compensating circuit includes another MOS transistor that is connected as a voltage follower in saturation. Variations in the component of the reference voltage that are produced by the effects of process variation on this other MOS transistor act to correct the current variations that these same process variations cause in the diode-connected MOS transistor.

11 Claims, 1 Drawing Sheet

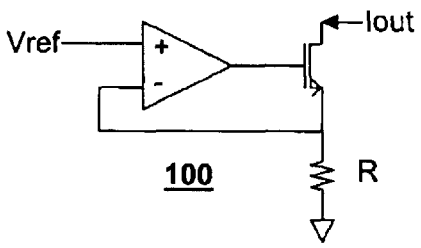
FIG. 1 [Prior Art]
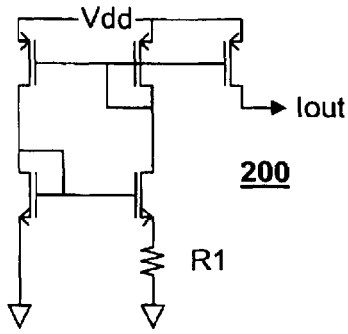
FIG. 2 [Prior Art]
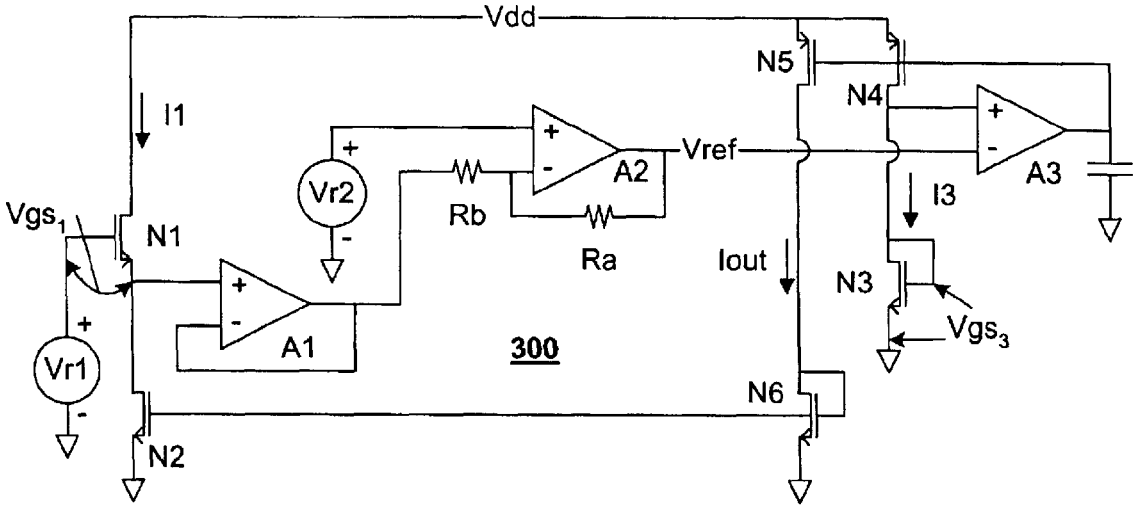
FIG. 3

PROCESS-COMPENSATED CMOS CURRENT REFERENCE

BACKGROUND OF THE INVENTION

1. Field of the Invention

This invention relates to the field of electronic circuit design, and in particular to a CMOS current generator that provides an output current that is insensitive to process parameters, specifically, insensitive to threshold voltage.

2. Description of Related Art

Conventional current sources are dependent upon a number of factors, including temperature, voltage, and process variations. Bandgap voltage references can provide a stable voltage, and PTAT (proportional-to-absolute-temperature) circuits can be used to compensate for current changes with temperature. Process variations generally affect the threshold voltage Vt of the fabricated transistors, and a variety of techniques have been developed for generating a current that is insensitive to the threshold voltage Vt.

FIGS. 1 and 2 illustrate example circuit diagrams of conventional constant-current sources 100 and 200, respectively. In FIG. 1, a bandgap voltage typically provides a reference voltage Vref, and a high gain operational amplifier controls the current through an NMOS transistor so as to maintain this reference voltage across a resistor R. This controlled current will be equal to Vref/R, and will be independent of Vt. As is known in the art, however, the fabrication of a resistor can result in a variance of resistance of as much as 40%. FIG. 2 illustrates a current source 200 that does not rely upon a reference voltage, per se, and is commonly referred to as a "beta multiplier referenced self-biasing current source". The output current of the current source 200 is independent of Vt, but it is dependent upon the resistance value of a resistor R1, which, as noted above, is difficult to control. Often, the resistor R1 is trimmed after fabrication to provide the desired output current, but this is generally a costly process step.

U.S. Pat. No. 5,469,111, "CIRCUIT FOR GENERATING A PROCESS VARIATION INSENSITIVE REFERENCE BIAS CURRENT", issued Nov. 21, 1995 to Kwok-F Chiu, presents a current generator wherein the Vt-independent reference current is based on the difference between two base-emitter voltages of two bipolar transistors, and does not depend upon a controlled resistance value.

Japanese patent JP 1-263706, "BIAS CIRCUIT", issued 20, Oct. 1989 to Daijiro Inami, presents a current generator wherein the Vt-independent reference current is based on maintaining a particular relationship of sizes of N-MOS transistors, and also does not depend upon a controlled resistance.

BRIEF SUMMARY OF THE INVENTION

It is an object of this invention to provide a current source that is independent of process variations, particularly variations in threshold voltage, Vt. It is a further object of this invention to provide a Vt-independent current source that can be embodied using MOS technology.

These objects and others are achieved by a current-compensating circuit that provides compensation to a reference voltage such that the current through a diode-connected MOS transistor remains constant, regardless of threshold voltage. The compensating circuit includes another MOS transistor that is connected as a voltage follower in saturation. Variations in the component of the reference voltage that are produced by the effects of process variation on this other MOS transistor act to correct the current variations that these same process variations cause in the diode-connected MOS transistor.

BRIEF DESCRIPTION OF THE DRAWINGS

The invention is explained in further detail, and by way of example, with reference to the accompanying drawings wherein:

FIG. 1 illustrates an example circuit diagram of a conventional current source, based on a reference voltage.

FIG. 2 illustrates an example circuit diagram of a beta-multiplier referenced self-biasing current source that does not rely upon a reference voltage.

FIG. 3 illustrates an example circuit diagram of a process-independent current source in accordance with this invention.

Throughout the drawings, the same reference numerals indicate similar or corresponding features or functions.

DETAILED DESCRIPTION OF THE INVENTION

FIG. 3 illustrates an example circuit diagram of a process-independent current source 300 in accordance with this invention. N3 is a diode-connected N-MOS transistor through which the intended current I3 passes. This current I3 is expressed as:

$$I_3=\beta_3(V_{gs_3}-V_t)^2, \tag{1}$$

where $I_3$ is the current through the drain-source of transistor N3, $\beta_3$ is the intrinsic gain of the transistor N3, $Vgs_3$ is the voltage between the bite and source of the transistor N3, and Vt is the threshold voltage for bringing the transistor N3 into its conduction region. As noted above, the threshold voltage Vt is predominantly determined by parameters of the process used to create the transistor, and is generally consistent among all transistors of the same type within an integrated circuit. A differential amplifier A3 is configured to maintain $Vgs_3$ equal to Vref, via the transistor N4.

The voltage Vref is provided by the operational amplifier A2, and is given as:

$$Vref=(1+Ra/Rb)Vr_2-(Ra/Rb)Vx, \tag{2}$$

where Vx is the output of the buffer A1, and is given as:

$$Vx=Vr_1-V_{gs_1}. \tag{3}$$

In accordance with this invention, the amplifier A2 and transistor N1 are configured to provide a compensation voltage for the threshold voltage Vt of transistor N3. The gate-to-source voltage $Vgs_1$ of transistor N1 is dependent upon its threshold voltage, which is assumed to be equal to the threshold voltage of transistor N3.

$$V_{gs_1}=\sqrt{I_1/\beta_1}+V_t. \tag{4}$$

Combining equations 2–4, $$Vref=Vr_2+(Ra/Rb)(Vr_2-Vr_1+\sqrt{I_1/\beta_1}+V_t). \tag{5}$$

Thus, combining equations 1 and 5, the current I3 through N3 is given as:

$$I_3=\beta_3(Vr_2+(Ra/Rb)(Vr_2-Vr_1+\sqrt{\sqrt{I_1/\beta_1}+V_t})-V_t)^2,$$

or, $$I_3=\beta_3(Vr_2+(Ra/Rb)(Vr_2-Vr_1+\sqrt{I_1/\beta_1})+(Ra/Rb-1)V_t)^2. \quad (6)$$

As can be seen, the amplifier A2 effects an inversion of the sense of the threshold voltage Vt, relative to the ($Vgs_3$−Vt) term in the original I3 equation (1). Thereby, the current I3 can be made to be independent of the process-dependent threshold voltage Vt by setting the values of the resistors Ra and Rb equal. As is known in the art, although the fabrication of a precise resistance value is difficult to control, the fabrication of substantially identical resistors is a straightforward task, requiring only that their layout artwork be substantially identical. Variations in the fabrication steps and processes will affect both resistors equivalently, thereby maintaining their equivalence.

Thus, by setting Ra=Rb, the circuit source 300 provides a current I3 that is independent of the process-dependent threshold voltage, Vt. An output current path comprising transistors N5 and N6, which are configured in the same manner as transistors N4 and N3, respectively, effect a current-mirroring of the current I3, to provide a current Iout that is independent of the threshold voltage Vt. In a typical application, the load that receives this process-independent current is placed in series between transistors N5 and N6.

The reference voltages Vr1 and Vr2 can be adjusted to provide the desired value of I3. As would be evident to one of ordinary skill in the art, Vr1 should be sufficient to bring transistor N1 into its conduction region, to provide a non-zero I1, whereas the voltage source for Vr2 can be any value within the proper operating range of amplifier A2.

The foregoing merely illustrates the principles of the invention. It will thus be appreciated that those skilled in the art will be able to devise various arrangements which, although not explicitly described or shown herein, embody the principles of the invention and are thus within its spirit and scope. For example, the principles of this invention may be combined with other techniques that further reduce the output current's dependencies on other factors. As illustrated in FIG. 3, transistor N2 is configured to provide the source of current I1. Replacing transistor N2 with a PTAT (proportional-to-absolute-temperature) current source, common in the art, can provide compensation for changes in the output current caused by temperature variations. In like manner, the equations presented above are based on the generally accepted first-order approximation of the operation of semiconductor devices. Common techniques for optimizations of performance, such as the trimming of resistors to provide values and/or ratios that differ from the theoretical 'optimum' values or ratios may be applied as desired. These and other system configuration and optimization features will be evident to one of ordinary skill in the art in view of this disclosure, and are included within the scope of the following claims.

I claim:

1. A current source comprising:

a current limiting device that provides a controlled current that is dependent upon a control voltage, and a threshold voltage, wherein the current limiting device includes a first MOS transistor whose characteristics include the threshold voltage a voltage limiting device that provides a compensation voltage that is also dependent upon the threshold voltage, wherein the voltage limiting device includes a second MOS transistor whose characteristics also include the threshold voltage; and a device that inverts the compensation voltage to form a component of the control voltage that includes the threshold voltage at an opposite polarity to the threshold voltage at the current limiting device, thereby reducing the controlled current's dependency upon the threshold voltage, wherein the device is an operational amplifier having:

an inversion input that is coupled to the compensation voltage, and an output that provides the control voltage.

2. The current source of claim 1, wherein the current limiting device also includes a differential amplifier that includes:

an inversion input that is coupled to the control voltage, a non-inversion input that is coupled to a drain node of the first MOS transistor, and an amplifier output; and a control transistor that is configured to receive the amplifier output and to provide therefrom the controlled current that is coupled to the drain node of the first MOS transistor.

3. The current source of claim 2, wherein the current limiting device also includes a current mirror that is configured to provide an output current that corresponds to the controlled current.

4. The current source of claim 1, wherein the first MOS transistor is configured as a diode.

5. The current source of claim 1, further including a source that provides a temperature-dependent current, wherein the compensation voltage is also dependent upon the temperature-dependent current.

6. A current source comprising:

a first transistor that includes:

a drain that is coupled to a first voltage source, a gate that is coupled to a first voltage reference, and a source that is coupled to a second voltage source;

a first amplifier that includes:

a first input that is coupled to the source of the first transistor, and an output;

a second amplifier that includes:

a first input that is coupled to the output of the first amplifier, and a second input, and an output;

a second transistor that includes:

a drain that is coupled to the second input of the second amplifier, a gate that is coupled to the drain of the second transistor, and a source that is coupled to the second voltage source; and a third transistor that includes:

a gate that is coupled to the output of the second amplifier, a source that is coupled to the first voltage source, and a drain that is coupled to the drain of the second transistor.

7. The current source of claim 6, wherein the first amplifier also includes a second input that is coupled to a second voltage reference.

8. The current source of claim 6, further including a temperature-dependent current source that is in series between the source of the first transistor and the second voltage source.

9. The current source of claim 6, further including a fourth transistor that includes:

a drain that is coupled to the first voltage source, a gate that is coupled to the output of the second amplifier, and a source; and a fifth transistor that includes a drain that is coupled to the source of the fourth transistor, a gate that is coupled to the drain of the fifth transistor, and a source that is coupled to the second voltage source.

10. The current source of claim 6, further including:

a first resistor that is coupled from the output of the first amplifier to the first input of the first amplifier, and a second resistor that is coupled in series between the drain of the first transistor and the first input of the first amplifier.

11. The current source of claim 10, further including a buffer that is coupled in series between the drain of the first transistor and the second resister.

* * * * *